US005291701A

United States Patent [19]

Delacollette et al.

[11] Patent Number: 5,291,701

[45] Date of Patent: Mar. 8, 1994

[54] EXTENDIBLE RIGID CONSTRUCTION

[75] Inventors: Michel Delacollette, Nandrin; Charles A. Piette, Nassogne, both of Belgium

[73] Assignee: Espace Mobile International S.A., in short "E.M.I.-S.A.", Aubange, Belgium

[21] Appl. No.: 474,848

[22] PCT Filed: Jan. 1, 1990

[86] PCT No.: PCT/BE90/00005

§ 371 Date: Nov. 14, 1990

§ 102(e) Date: Nov. 14, 1990

[87] PCT Pub. No.: WO90/08861

PCT Pub. Date: Aug. 9, 1990

[30] Foreign Application Priority Data

Feb. 1, 1989 [BE] Belgium ..... 8900097

[51] Int. Cl.[5] ..... B60P 3/00

[52] U.S. Cl. ..... 52/67; 296/26

[58] Field of Search ..... 52/67; 296/26, 27, 175

[56] References Cited

U.S. PATENT DOCUMENTS

Re. 32,262 10/1986 Stewart ..... 52/67

3,719,386 3/1973 Puckett et al. ..... 52/67

FOREIGN PATENT DOCUMENTS 2601609 7/1977 Fed. Rep. of Germany ..... 296/26

*Primary Examiner*—Carl D. Friedman

*Assistant Examiner*—Wynn Wood

*Attorney, Agent, or Firm*—Charles F. Meroni, Jr.

[57] ABSTRACT

A structure comprising a first fixed unit and at least a second unit encompassing the fixed unit, whereby the second unit is located so as to be able to slide transversely relative to the axis of the fixed unit in order to extend the internal volume of the structure. The floor of the movable unit comprises an horizontal section and a pivotable section connected to the horizontal section by means of an horizontal hinge. The extendable structure can be moved in the form of a trailer or a semi-trailer or is transportable in the form of a container.

8 Claims, 4 Drawing Sheets

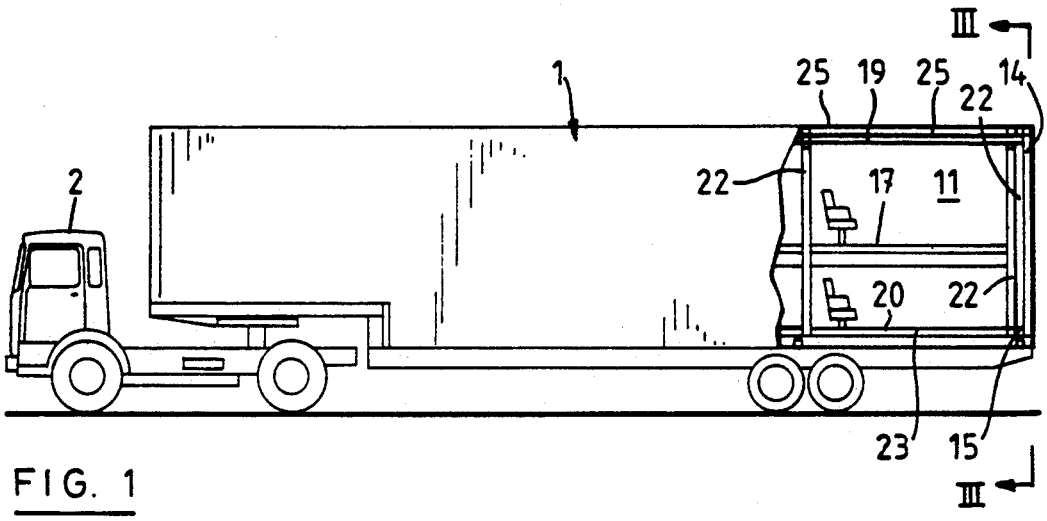
FIG. 1
FIG. 2
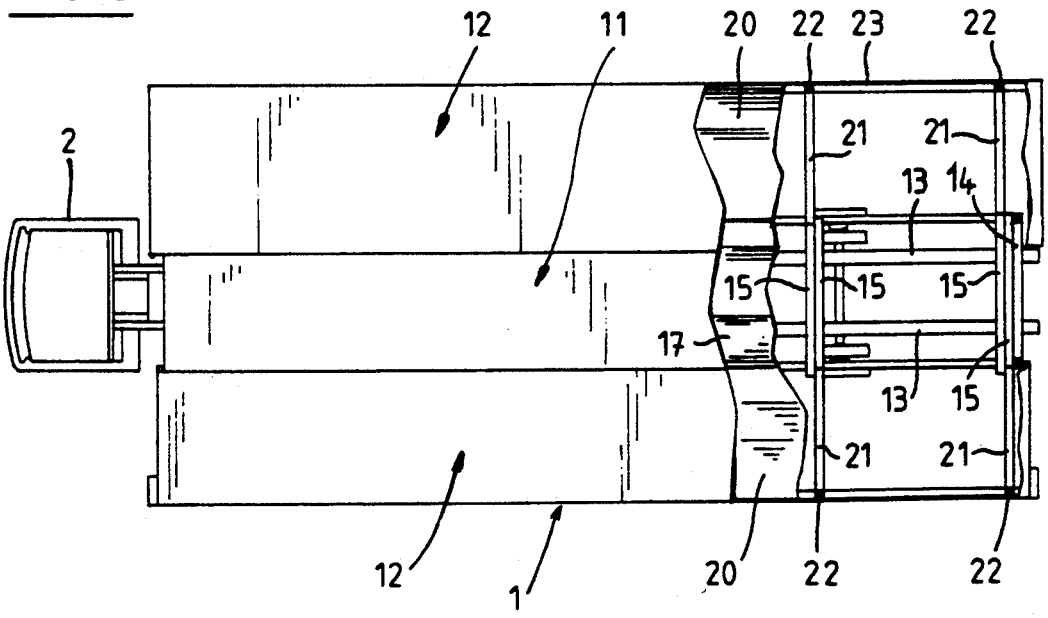

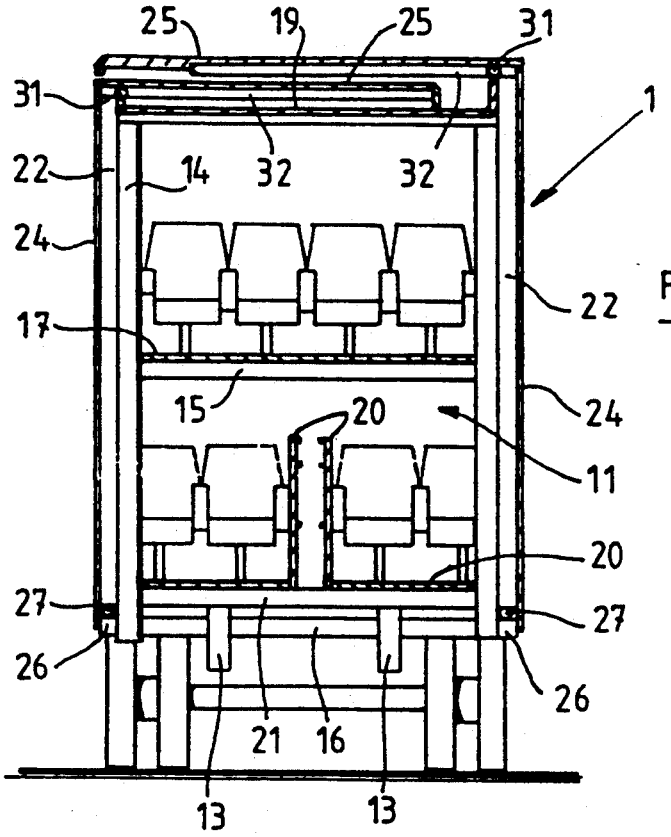
FIG. 3
FIG. 6
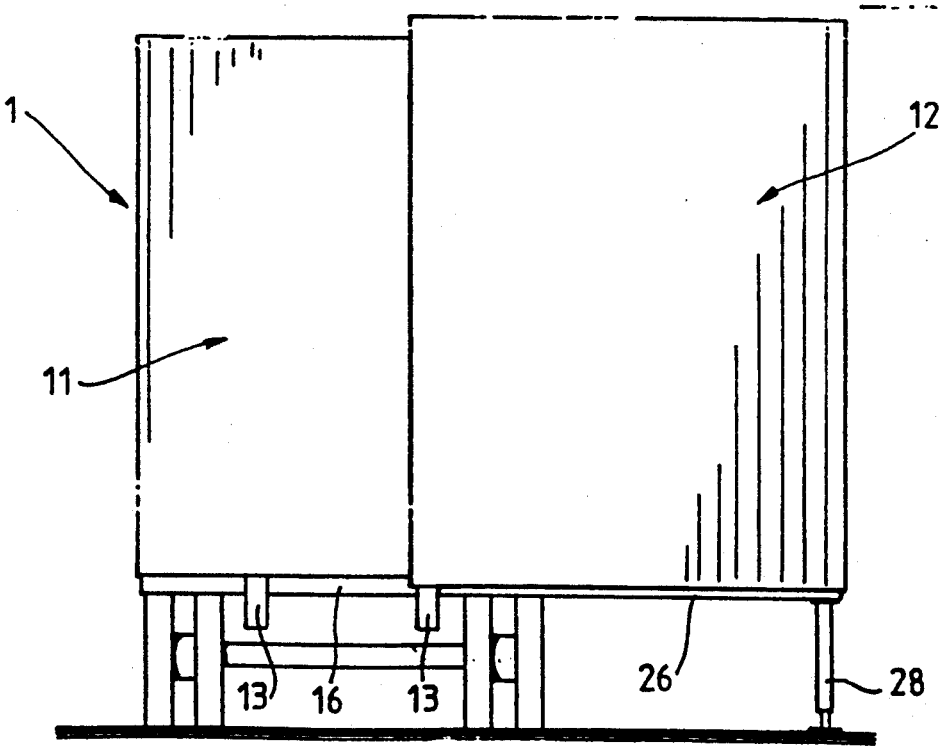

EXTENDIBLE RIGID CONSTRUCTION

BACKGROUND OF THE INVENTION

The present invention relates to a rigid construction which offers an extendible internal space and which, if required, can be moved in the form of a trailer or semi-trailer or be transported in the form of a container.

Activities in various fields such as culture, sport, medicine, civil defense and education sometimes require the temporary use of a confined space offering a useful volume that is adequate and in any case greater than would be provided by a bus, a coach, a semitrailer or a container for example. Examples which may be cited are a mobile medical clinic, a mobile command centre, a travelling cinema, a travelling exhibition room, a mobile dispensary and the like.

In the present state of the art, the requisite useful spaces can be produced by erecting constructions of flexible material, for example a tent, or by erecting constructions of rigid material, for example huts, single-storey constructions, containers and the like. The erection of constructions of this kind necessitates numerous handling operations and does not quickly offer the final space required for the desired use.

To extend the useful space requires an amount of manpower which may be considerable (for example pitching a tent), the execution of preparatory construction work (for example casting a solid bed or plinths beneath huts) or many often difficult handling operations (for example assembling and adjusting containers).

SUMMARY OF THE INVENTION

The object of the present invention is to respond to this need of the market by providing a rigid construction which, starting from an initial space imposed by the particular conditions, for example a transport regulation (size of an ordinary container or load), enables a larger useful space to be created rapidly while requiring the work of only one person.

In accordance with the invention, there is provided a rigid construction notable in that it comprises a first fixed box and at least one second box surrounding the fixed box, the second box being mounted so as to be able to slide transversely to an axis of the fixed box in order to extend the internal volume of the construction.

In an illustrative non-limiting embodiment, the fixed box is carried by a plurality of fixed crossbars and the second box is mounted on a plurality of sliding crossbars which are mounted to slide along the fixed crossbars.

A preferred embodiment comprises sliding crossbars which are mounted to slide inside hallow fixed crossbars and they slide on rolling means.

Advantageously, the sliding crossbars roll with the aid of rollers on retractable rolling crossbars.

In a particular embodiment, the sliding crossbars carry brackets (22) serving as a support for the casing of the movable box.

On the interior face of the roof of the sliding box are advantageously a plurality of sliding channels for the suspension of rollers integral with the fixed roof of the box.

The casing of the second box can be formed with support means which are an integral part of the casing. It could also be self-supporting.

The floors of the fixed box and sliding box(es) can be mounted in various ways. For example, the floor which is integral with the fixed structure can be mounted on lifting means arranged to raise the said floor when the second box or boxes are retracted 96 that the floor of the or of each second box can be accommodated beneath it. The floor of the or of each second box can also be articulated to the structure of the said box so as to be able to be raised by pivoting when the sliding box is in the retracted position. Also only a part of the floor of each sliding box may be articulated. The floors may advantageously be mounted over vibration damping devices.

The constructions according to the invention can be put in place and opened out without the need for qualified staff and without the use of expensive or non-standardized materials or components. What is more, the constructions of the invention can be put in place equally well in normal environmental conditions and in hostile conditions (very low temperature, presence of toxic gases etc.).

According to one particular embodiment of the invention, the casing of each sliding box may consist of a shell of some rigid material, made in a single piece which is placed upon and fixed to the brackets, which it surrounds. Advantageously, each rigid shell can be formed so that the brackets or any other support structure are an integral part of it. The shells could also be self-supporting and secured to sliding means.

In the retracted position, a construction according to the invention forms a space which is delimited by a compact parallelepipedic casing, enabling it to be moved in the form of a semitrailer or trailer or transported by boat, helicopter, lorry or railway, in the form of a container.

The internal space of the construction can be fitted out for a wide variety of applications and may hold a large quantity of various kinds of equipment within the limits of constraints imposed by the initial volume, this equipment being ready for use as soon as the construction has been opened out on site.

BRIEF DESCRIPTION OF THE DRAWINGS

An illustrative embodiment in accordance with the invention is described below with the aid of the attached drawings.

FIG. 1 illustrates an illustrative embodiment of a construction in accordance with the invention.

FIG. 2 is a top view, with cutaway, of the construction of FIG. 1, when opened out.

FIG. 3 shows a cross-sectional view through the line III—III of FIG. 1, on an enlarged scale.

FIG. 6 illustrates an alternative embodiment of the construction according to the invention.

DESCRIPTION OF THE PREFERRED EMBODIMENT

Figure 4:
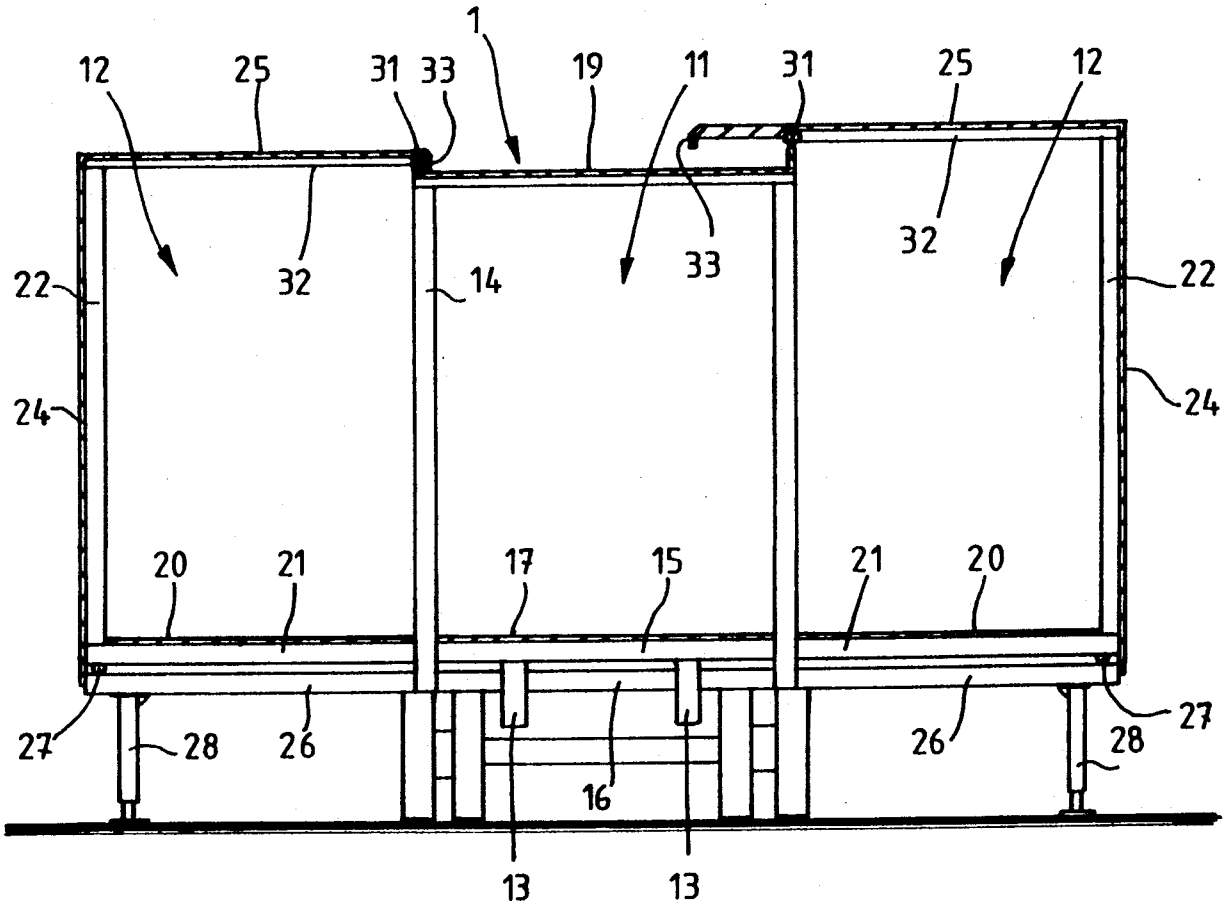
FIG. 4 is a similar view to FIG. 3, but showing the construction when opened out.

An illustrative construction in accordance with the invention is shown in FIG. 1. This construction takes the form of a semitrailer 1 coupled to a motorized towing vehicle 2. The structure of the construction 1 according to the invention is arranged, as will be seen in detail further on, so that the construction is extendible by simple lateral translation of the two sides of the longitudinal axis of the complete coupled vehicle as shown in FIG. 2. The internal volume can thus be enlarged by a ratio of 1 in the transport position to 2.5 for example when opened out for use on site.

The construction's extendibility is made possible by a particular structure which is described below. The general structure is composed of a fixed box 11 mounted here on girders 13 forming a supporting chassis and of at least one box which can be moved by translation relative to the fixed box, in this case two lateral boxes 12 visible in FIGS. 2 and 4 in particular.

The fixed box 11 comprises a structure consisting of two end frames 14 (a forward end frame and a rear end frame) and a plurality of parallel crossbars 15 fixed to the girders 13. The crossbars 15 are for example hollow profiles serving as slides for sliding crossbars integral with a movable box. In the illustrative embodiment shown in the drawings, the fixed box also comprises a plurality of second crossbars 16 (FIG. 3) arranged under the first crossbars 15 to serve as slides for rolling crossbars to support the sliding structures when they are opened out (see FIG. 4). A central floor 17 is integral with the fixed structure.

The dimensioning of girders and crossbars, in particular their cross-section, is determined by the load and the use conditions.

Each movable box 12 is mounted on a structure to slide it relative to the fixed box. In the example illustrated, the box 12 is mounted on a plurality of brackets 22 fixed to sliding crossbars 21 which are mounted to slide along or inside fixed crossbars 15. Wheel boxes such as the box 29 (see FIG. 5) are advantageously provided to facilitate the sliding. The brackets 22 are connected to each other by struts 23. When the sliding crossbars 21 are opened out, they are preferably supported by rolling crossbars 26 sliding in the fixed crossbars 16. The crossbars 21 roll on the rolling crossbars 26 by means of rollers 27. The extremities of the rolling crossbars 26 are supported by retractable legs 28 (FIG. 4).

Figure 5:
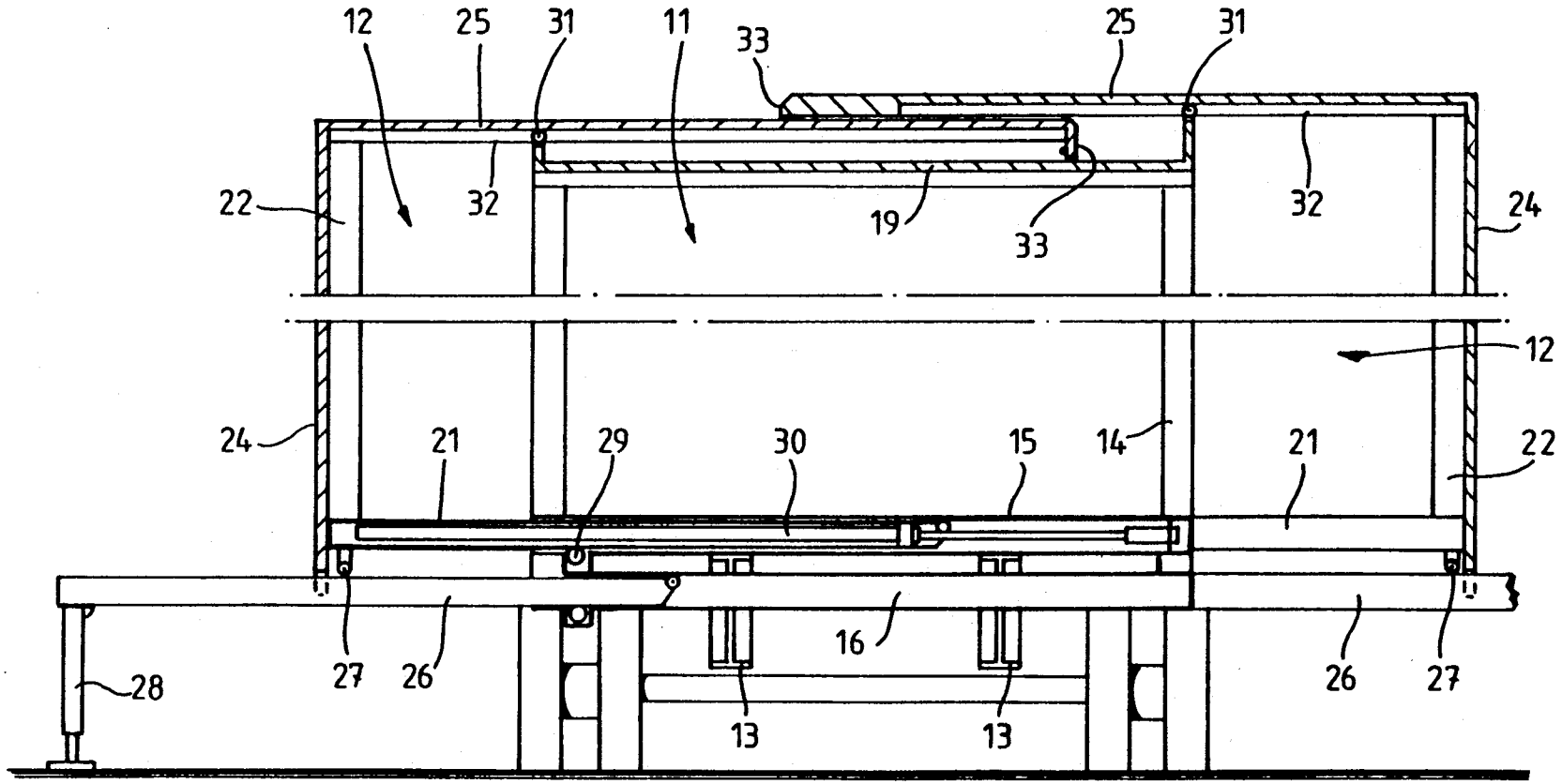
FIG. 5 is a view on a larger scale of an example of a sliding mechanism used in the construction according to FIGS. 3 and 4.

Sliding can be controlled by means of any system: hydraulic, electrical, mechanical. FIG. 5 illustrates diagrammatically an embodiment employing a hydraulic system. Double-acting cylinders 30 are accommodated inside (or alongside) the crossbars 15. They are fixed to the extremities of the crossbars 15 and 21 and to the brackets 22. Their total travel corresponds to the maximum opening out of each sliding structure. The cylinders are fed through a flow divider (not shown) the purpose of which is to make it possible to move the walls strictly parallel to the longitudinal axis of the chassis.

It goes without saying that the extendible construction according to the invention need not necessarily comprise two sliding boxes 12 and be extendible on both sides of the fixed box 11. Extendibility may be envisaged on one side only by means of a single sliding box 12 as illustrated for example in FIG. 6.

The fixed roof is connected at the front and rear to the fixed structure 11 and is supported by the upper arms of the brackets 22. Rainwater is envisaged to run off to the front and rear of the construction.

When the construction is in the retracted position (the transport position), the lateral roofs 25 cover each other and the central roof 19 (FIG. 3). The central roof is suspended from each lateral roof 25 by means of pads 31 accommodated in sliding channels 32 formed in the internal surface of the lateral roof 25. The inner end 33 of the roofs 25 is provided with a pad arranged to slide on the roof which it comes over.

When the sliding boxes 12 are made to slide, in order to extend the extendible construction (FIG. 5), their roofs 25 slide on the pads 31 and the pad which is provided on the inner end of each of these roofs slides on the roof it is cooperating with. Preferably, the pads on the inner end 33 of the roofs 25 slide on a sliding piece fixed on the roof of the underlying box. In the extended position (FIG. 4), the roofs 25 of the movable boxes 12 overlap the roof 19 of the fixed central box. Compressible seals are advantageously provided, as in a decompression space.

At the front and rear ends of the construction, the vertical walls of the movable boxes slide relative to the central vertical wall, covering each other in the transport position. Compressible seals and decompression spaces are also provided.

The casing of each box may consist of rigid panels fastened to the respective structures. Materials, dimensions, shapes and insulation are selected in accordance with the application concerned. Openings may be provided in the surfaces for doors, windows, skylights or suchlike depending on the applications.

The floors may be equipped with all the equipment needed for the application concerned and the fitting out of the internal space may be freely decided in accordance with the application, though within the limits of the constraints imposed by the initial volume in the retracted position. It is thus possible to set out exhibition stands with a central gangway or lateral gangways, to lay out a reception area and various activity or meeting areas, and to set out seats for a hall for lectures or for showing films, to cite only a few typical examples.

The floors, which are integral with the fixed structure and movable structure(a), can be mounted in various ways depending on the equipment with which the internal space is to be equipped. Depending on the case, the floor of each movable box 12 can be articulated to the structure of the box so that it can be raised by pivoting when the movable box is to be retracted.

In an application in which equipment is to be installed on the floor of the fixed box, for example seats for a hall for lectures or film-showing, the floor 17 of the fixed box 11 can be mounted on lifting means (for example hydraulic cylinders) enabling this floor to be raised when the construction is to be retracted (see FIGS. 1 and 3). The floor 20 then slides with the movable box 12 with which it is integral until it is accommodated under the now raised central floor 17. The floors can be mounted on vibration damping devices.

A useful advantage of the construction according to the invention lies in its being quick to put in place for operations without necessitating qualified staff. Its placing does not require an absolutely plane resting surface. Unevennesses of the surface can be compensated for by adjusting the horizontality of the floor by a system of legs which bear on the supporting structures. This compensation system can be operated by mechanical or hydraulic control.

Another advantage of the construction according to the invention is that, after having been put in place and used on a site, it can be retracted so as to reduce its bulk to dimensions that will allow it to be moved or transported by current means.

An example of an application of the invention is the making of a travelling cinema. A closed flat surface, as long and as wide as possible, in which up to 88 cinema seats can be arranged, may be made with a trailer having a width of for example 6 meters. The trailer can be widened by operating hydraulic cylinders connected to the pump of the towing vehicle. Leaktightness between the movable and fixed boxes is obtained by an integrated gutter system.

After extension on site, the central floor is set level with the two lateral floors. The seats can be set out on the central floor and on the lateral floors. During retraction, the central floor is raised hydraulically above the level of the seats occupying the lateral floors, and the seats fixed to the lateral floors are brought in with the lateral floors beneath the now raised central floor, by the translation of the sliding structures (see FIG. 3). The lateral floors then take the place of the central floor. When the construction is in the retracted position, the central floor rests on stops fixed to the brackets.

The twofold advantage of this system is that it provides a large number of available spaces in a small volume when travelling around and that it provides seats which remain fixed and therefore do not require a long time to put them in place. The whole unit is made operational in about 15 minutes.

In accordance with a particular aspect of the invention, the casing of each sliding box may consist of a shell of some rigid material, made in a single piece which is placed upon and fixed to the brackets, which it surrounds. In an advantageous embodiment, each rigid shell can be formed so that the brackets or any other support structure are an integral part of it. The shells could also be self-supporting and secured to the sliding means.

The example described in the foregoing is an example given by way of illustration and the invention is in no way limited to this example. Any modification, any variant and any equivalent arrangement must be considered as falling within the scope of the invention.

Thus, for example, the construction may be produced without rolling gear and take the form of an extendible container or construction on the ground.

We claim:

1. An extendable rigid construction comprising:

a first fixed box unit mounted on a fixed supporting chassis including parallel fixed crossbars carrying a floor, said first box unit having at least one open lateral side, at least one second moveable box unit adapted to telescope at least partially over the first box unit, said second moveable box unit being mounted on slidable crossbars capable of sliding along said fixed crossbars between a retracted position and an extended position, said second moveable box unit being provided with a floor connected to said slidable crossbar, the floor comprising a horizontal section connected to said slidable crossbars and a pivotable section connected to the horizontal section by means of a horizontal hinge, said pivotable section being pivoted towards a substantially vertical position when the moveable box is in retracted position and said pivotable section being pivoted about said horizontal hinge into a horizontal position whereby said pivotable section is resting on the slidable crossbars when the moveable box unit is in an extended position, and driving means fixed to the fixed supporting chassis in order to cause the slidable crossbars to slide along said fixed crossbars.

2. An extendable rigid construction as defined in claim 1, wherein said crossbars carrying the floor of the first box unit are mounted on lifting means arranged to raise said floor when the second box unit is in retracted position, while the floor of the second box unit is accommodated beneath the floor, and to bring said floor of the first box unit towards a lowered position when the second box unit is made to slide towards its extended position, with the floor of the second box in extended position being level with said floor of the first box unit in lowered position.

3. An extendable rigid construction as defined in claim 1, wherein said slidable crossbars carrying the second telescoping box unit are resting at their outer extremities on rollers arranged to roll on rolling crossbars capable of sliding inside fixed crossbars hanging from the fixed supporting chassis, the extremities of the rolling crossbars being provided with retractable legs for supporting the rolling crossbars when the latters are in extended position; and the roof of the first box unit is suspended from the roof of the second box unit by means of pads accommodated in sliding channels formed in the internal surface of the roof of the second box unit such that when the second box unit is made to slide relative to the first box unit, the roof thereof is made to slide on said pads.

4. An extendable rigid construction as defined in claim 3, comprising a second telescoping box unit mounted to slide laterally on each side of the first box unit, wherein the roofs of both second box units cover each other when said second box units are in retracted position, the roof of each second box unit overlapping the roof of the first unit when the second box units are in extended position.

5. Extendible rigid construction as defined in claim 4, wherein the floors are laid over vibration damping devices.

6. Extendible rigid construction as defined in claim 5, wherein the supporting chassis is equipped with at least one train of wheels.

7. Extendable rigid construction as defined in claim 6, wherein the crossbars on which is mounted the second box unit carry brackets to which are fixed the lateral walls and the roof of the box unit.

8. Extendible rigid construction as defined in claim 7, wherein the casing of each box unit is self-supporting.

* * * * *